United States Patent [19]

Ruscheweyh

[11] Patent Number: 4,580,401

[45] Date of Patent: Apr. 8, 1986

[54] FORCED-AIR COOLED CONDENSER SYSTEM

[75] Inventor: Hans Ruscheweyh, Aachen, Fed. Rep. of Germany

[73] Assignee: Balcke-Dürr Aktiengesellschaft, Ratingen, Fed. Rep. of Germany

[21] Appl. No.: 629,630

[22] Filed: Jul. 11, 1984

[30] Foreign Application Priority Data

Jul. 12, 1983 [DE] Fed. Rep. of Germany ..... 3325054

[51] Int. Cl.[4] ..... F28B 1/06

[52] U.S. Cl. ..... 60/693; 165/110; 165/900

[58] Field of Search ..... 165/DIG. 1, 122, 110; 60/690, 693

[56] References Cited

U.S. PATENT DOCUMENTS 3,519,068 7/1970 Harris et al. ..... 165/DIG. 1
4,029,144 6/1977 Harris ..... 165/DIG. 1

FOREIGN PATENT DOCUMENTS 1170415 11/1969 United Kingdom ..... 165/DIG. 1
2086559 5/1982 United Kingdom ..... 165/DIG. 1

*Primary Examiner*—Albert W. Davis, Jr.
*Attorney, Agent, or Firm*—Becker & Becker Inc.

[57] ABSTRACT

A forced-air cooled condenser system having a plurality of heat exchange elements, preferably roof-shaped heat exchange elements with a steam distribution line which forms the ridge of the elements. Cooling air is supplied to the heat exchange elements via fans. The heat exchange elements are disposed directly next to a turbine housing, and are disposed parallel to one another. In order to prevent the danger of a recirculation of the warm air which emerges from the heat exchange elements, a concentrated air draft in the form of a sort of aerodynamic wall is blown out along at least that edge of the condenser system which extends parallel to the turbine housing. The velocity of flow of the air draft is greater than the exit velocity of the cooling air from those heat exchange elements which are disposed in the middle.

11 Claims, 8 Drawing Figures

FORCED-AIR COOLED CONDENSER SYSTEM

BACKGROUND OF THE INVENTION

1. Field of the Invention

The present invention relates to a condenser system which is forced-air cooled and includes a plurality of heat exchange elements, preferably roof-shaped heat exchange elements having a steam distribution line which forms the ridge of the elements. Cooling air is supplied to the heat exchange elements by fans. The heat exchange elements are disposed directly next to a turbine housing, and are disposed parallel to one another.

2. Description of the Prior Art

In the recent past there has been a recognizable trend to continuously larger power plant outputs with direct condenser systems. Steam exhaust from the turbines is conveyed via large-volume conduits directly into forced-air cooled heat exchange elements, where such steam exhaust is condensed. The cooling air is delivered by fans which are customarily disposed on the intake air side below the heat exchange elements. To avoid long paths, which result in a reduction of the condensation temperature and hence a reduction of the efficiency of the condenser system, the heat exchange elements are disposed directly next to the turbine housing.

Condenser systems are known according to which, to reduce the space required, the heat exchange elements are roof-shaped, with the ridge thereof being formed by the steam distribution line. Since the length of a heat exchange element is limited for thermohydraulic reasons, the roof-shaped heat exchange elements are preferably disposed parallel to the front of the turbine housing, so that despite the limited length of the heat exchange elements, the overall condenser system can be constructed as deep as desired.

Especially, when, for reasons of space, a plurality of power plant units are arranged in a row next to one another, unfavorable in-flow conditions result with regard to the air flow for the inwardly disposed heat exchange elements of the condenser system. Due to the turbine housing, as well as the adjacent heat exchange elements, virtually three of the four sides of the heat exchange elements are blocked off as in-flow cross-sectional areas for the cooling air. The air velocity on the remaining free side is therefore very high, since all of the fans must be supplied with fresh or intake air via this cross-sectional area.

Experiments have shown that the recirculation of warm air, i.e. of cooling air which has been warmed up by absorbing heat as the cooling air flows through the heat exchange elements, also increases as the velocity of the intake air supplied to the fans increases. In this case, the fans draw in an air mixture which has a higher temperature than does the atmospheric air. The immediate result is a reduction of the cooling capacity, and hence a reduction of the efficiency of the condenser system. The recirculation rate of the air increases especially when there is encountered a cross wind, the direction of which extends opposite to the in-flow direction of the cooling air, because the cross wind deflects the warm air which leaves the heat exchange elements in the direction toward the in-flowing intake air.

An object of the present invention is to provide a forced-air cooled condenser system of the aforementioned general type according to which the recirculation of warm exhaust air is considerably reduced, even under unfavorable wind conditions, without having to install expensive wind or air guiding apparatus in order to achieve this avoidance of recirculation of warm exhaust air.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
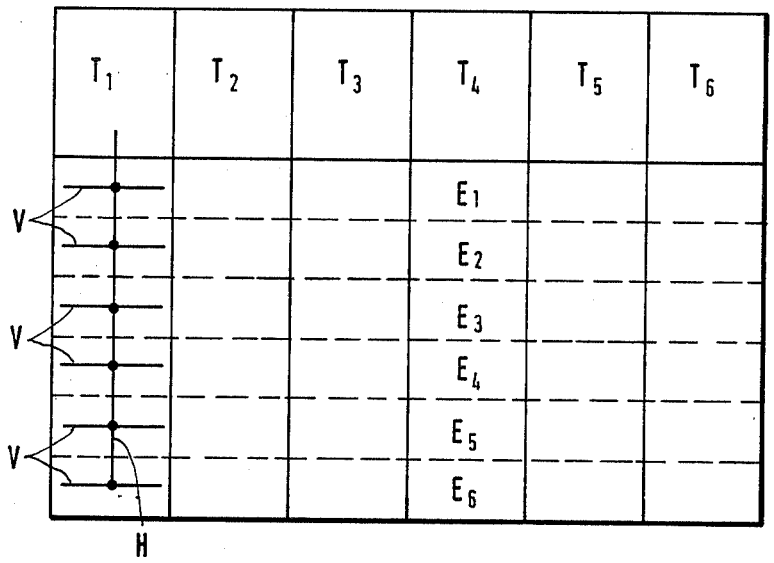
FIG. 1 is a plan view of a forced-air cooled condenser system for a plurality of adjacent power plant units.

The forced-air cooled condenser system of the present invention is characterized primarily in that a concentrated air draft in the form of a sort of aerodynamic wall is blown out at least along that edge of the condenser system which extends parallel to the turbine housing; the velocity of flow of the air draft is greater than the exit or discharge velocity of the cooling air from those heat exchange elements which are disposed in the middle, i.e. between the aforementioned edge and the turbine housing.

Pursuant to the inventive proposal, the outlet or exhaust air which is warmed up by the condensation of the steam and which emerges upwardly out of the heat exchange elements, escapes essentially upwardly and reaches higher air layers even along the edge of the condenser system. The concentrated air draft, which forms a sort of aerodynamic wall, even guides the warm exhaust air upwardly along the edge region of the condenser system, and thereby prevents portions of the warmed-up air from being picked up by the suction of the intake air, and from being recirculated to the heat exchange elements. The kinetic energy contained in the concentrated air draft even effects an upward deflection of the warm exhaust air when the wind comes from an unfavorable direction, especially from the turbine housing, thus trying to drive the warm exhaust air in the direction of the intake opening of the condenser system. In such a case, when the wind current encounters the concentrated air draft, the latter is deflected due to the wind pressure; nonetheless, the concentrated air draft at the same time effects an upward deflection of the wind current, so that even under unfavorable wind conditions the warmed-up exhaust air reaches higher air layers and is far enough from the suction of the inlet opening that an effective reduction of the recirculation is achieved.

Pursuant to a further feature of the present invention, the concentrated air draft can be produced by stronger and/or additional fans in those heat exchange elements which are disposed along the edge of the condenser system. Although in many situations it suffices to blow out a concentrated air draft only along that edge of the condenser system which extends parallel to the turbine housing, an improved effect can be achieved by also forming an aerodynamic wall from concentrated air drafts along the side edges of the system.

Pursuant to a preferred embodiment of the present invention, the concentrated air draft is produced by using suction or induced-draft type fans which are disposed on the upper side of the heat exchange elements; on the other hand, the heat exchange elements disposed in the middle of the condenser system are provided with compression or forced-draft type fans which are disposed on the bottom side. This inventive embodiment suffices in many cases to reduce to a harmless extent the recirculation which would otherwise lead to a reduction of the efficiency of the system.

Pursuant further to the present invention, the concentrated air draft at the edge of the condenser system also can be produced by additional air. For this purpose, in addition to the fans of those heat exchange elements disposed at the edge, blowers or separate air conduits can be provided which introduce additional air at the edge of the condenser system. In the last-mentioned case, there is possible to provide a large, central blower which delivers additional air for the production of the aerodynamic wall.

A concentrated air draft at the edge of the condenser system also can be produced by using nozzles which increase the velocity of the cooling air at the edge of the condenser system, thus, in this way leading, to a sort of aerodynamic wall. These nozzles furthermore serve to concentrate and accelerate the exhaust air of the fans or blowers. Although such an effect also can be achieved by utilizing a respective nozzle for each fan, an improved effect is achieved if a slotted nozzle is used which extends at least partially along an edge of the condenser system; with a sort of planar air draft emerging at high velocity from the nozzle.

Although it is sufficient in most cases to vertically orient the air exit openings of the nozzles, there is proposed pursuant to a further feature of the present invention to orient the air exit direction of the nozzles at an inclined angle which is opposed to the main direction of the wind. In this way, there is possible to take into account local conditions in a particularly effective manner.

DESCRIPTION OF PREFERRED EMBODIMENTS

Figure 2:
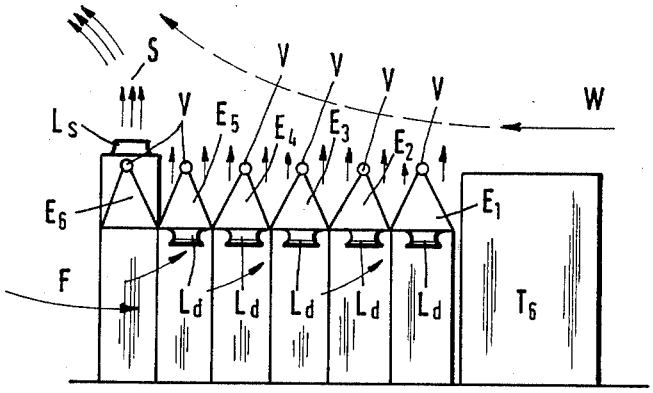
FIG. 2 is a side view of a first inventive embodiment for the condenser system illustrated in FIG. 1.

Referring now to the drawings in detail, the embodiment illustrated in FIGS. 1 and 2 shows a forced-air cooled condenser system for a total of six power plant units, the turbine housings $T_1$ to $T_6$ of which are disposed directly next to one another. Associated with each of the turbine housings $T_1$ to $T_6$ are six heat exchange elements $E_1$ to $E_6$, which are connected directly to the back side of the respective turbine housing $T_1$ to $T_6$.

As can be seen in particular in the side view of FIG. 2, each heat exchange element E is constructed in a roof-shaped manner of finned tubes; a steam distribution line V forms the ridge of the respective heat exchange element E. All of the ridges of the heat exchange elements E which are associated with a given turbine housing T are disposed parallel to one another as well as parallel to the front side of the turbine housing T. The heat exchange elements E associated with a given turbine housing T communicate via a main line H with the turbine, which is not illustrated in the drawing.

In the first inventive embodiment illustrated in FIG. 2, the heat exchange elements $E_6$, which are spaced the greatest distance from the respective turbine housing T, are provided on the upper side with suction or induced-draft type fans $L_s$, whereas the heat exchange elements $E_1$ to $E_5$ located therebetween are provided at their underside with compression or forced-draft type fans $L_d$. As a result, at that edge of the condenser system which extends parallel to the turbine housing T a concentrated air draft S is blown out, the flow velocity of which is greater than the outlet velocity of the cooling air from the heat exchange elements $E_2$ to $E_5$ which are located in the middle. The concentrated air draft S forms a sort of aerodynamic wall. As a result of this aerodynamic wall, even a cross wind W which is coming from the direction of the turbine housing T, as indicated in FIG. 2, is deflected upwardly, so that even in this unfavorable situation of a strong cross wind, the exhaust air which is warmed up in the heat exchange elements $E_1$ to $E_6$ reached higher air layers. Although the concentrated air draft S of FIG. 2 is deflected somewhat by the cross wind W, it nonetheless prevents the warmed-up exhaust air from passing into the suction of the inlet opening through which fresh or intake air F is supplied to the underside of the heat exchange elements $E_1$ to $E_6$.

Although in many cases there suffices to produce the concentrated air draft S by the use of induced-draft type fans $L_s$ disposed on the top side of the heat exchange element $E_6$, there may be necessary to arrange stronger and/or additional fans $L_s$ in the vicinity of the heat exchange element $E_6$, which is disposed along the edge. Pursuant to the embodiment of FIG. 3, there is furthermore possible to produce the concentrated air draft S, which produces the aerodynamic wall, by means of additional fans or blowers G disposed along the edge of the condenser system.

Figure 6:
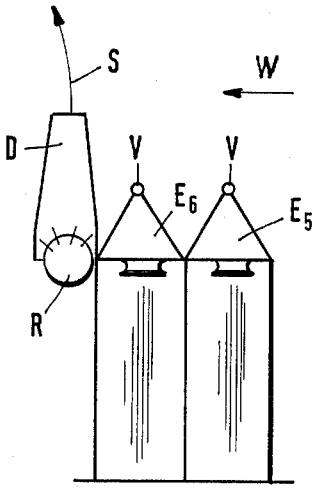
FIG. 6 is a schematic view of a further inventive embodiment.

The further embodiment of FIG. 6 shows that a concentrated air draft S also can be produced at the free edge of the condenser system by separate air conduits R which are disposed along the free edge of the condenser system and are provided with appropriate air outlet openings. These air conduits R are supplied with air from, for example, a central blower.

Figure 3:
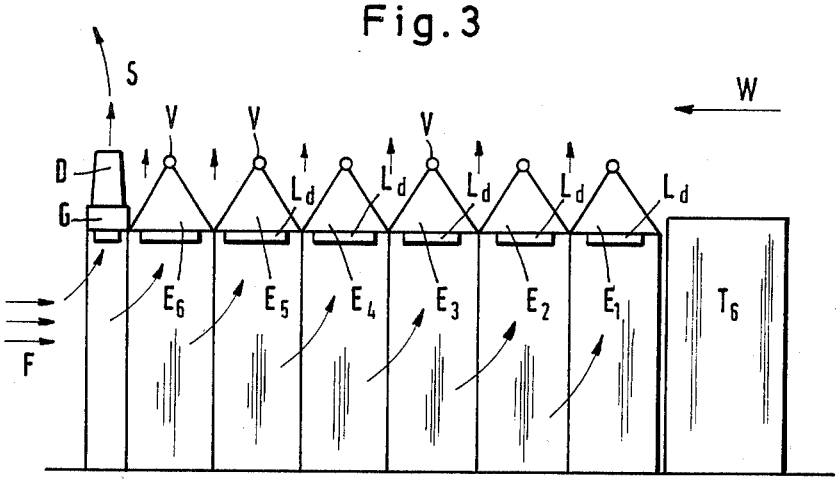
FIG. 3 is a side view of a second inventive embodiment for the condenser system illustrated in FIG. 1.
Figure 4:
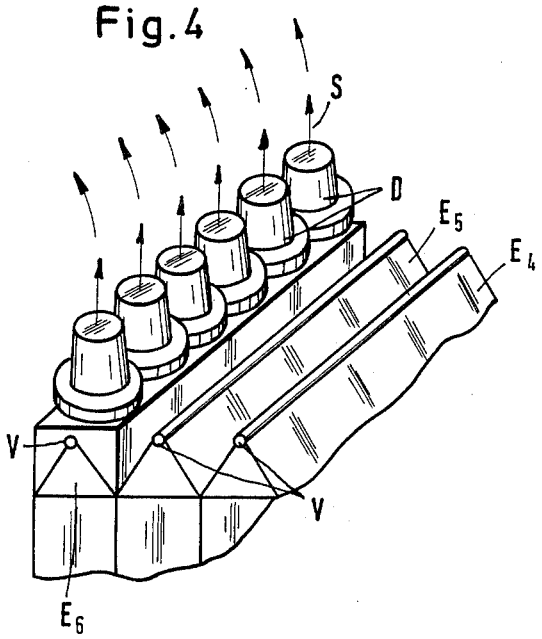
FIG. 4 illustrates a first embodiment for the construction of nozzle housings.
Figure 5:
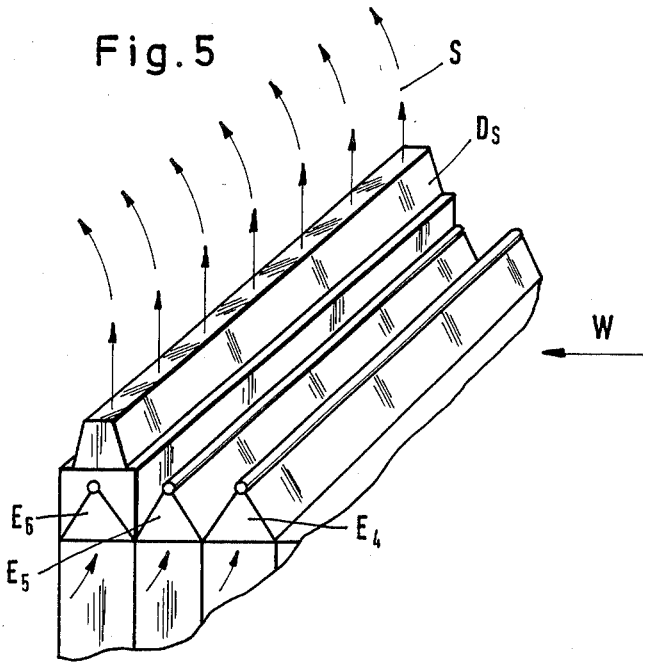
FIG. 5 illustrates a second embodiment for the construction of nozzle housings, with the nozzles being in the form of slotted nozzles.

In the embodiments of FIGS. 3 and 6, the concentrated air draft S emerges from nozzles D which, in addition to effecting an additional acceleration of the air draft S, also effect the concentration thereof. As illustrated in FIG. 4, these nozzles D can be individual nozzles, each of which has associated therewith a fan L or a blower G. Pursuant to the preferred embodiment of FIG. 5, a plurality of such nozzles are combined to form a slotted nozzle $D_s$, so that a continuous aerodynamic wall results.

Figure 7:
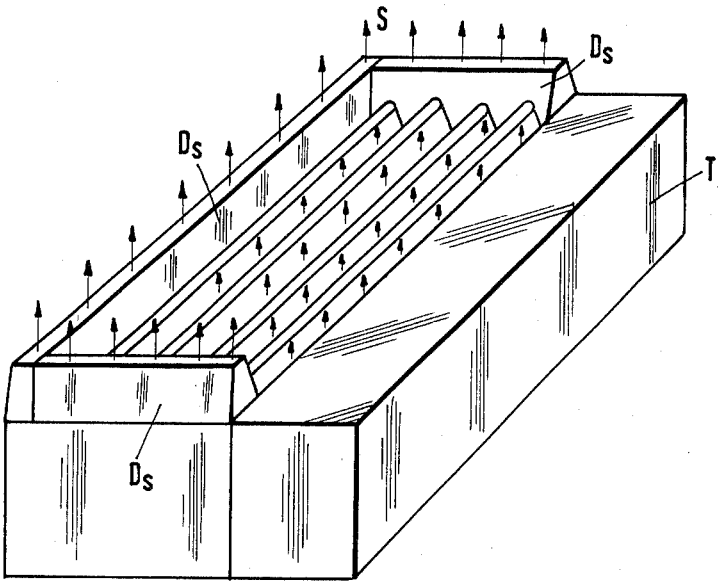
FIG. 7 is a view showing a complete condenser system having slotted nozzles disposed along all of the free edges.
Figure 8:
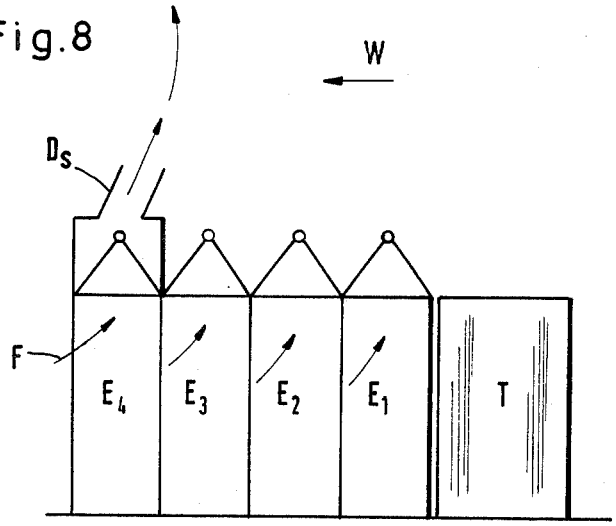
FIG. 8 is a side view of a modified inventive embodiment.

FIG. 7 shows an embodiment according to which such an aerodynamic wall is produced not only parallel to the turbine housing T along the edge of the condenser system, but also on those edges which extend at right angles to the turbine housing T. In so doing, the air leaving the heat exchange elements E is shielded against recirculation from all sides. To the extent that the cross wind W preferably blows from a single direction, the outlet direction of the nozzle $D_s$, as shown in FIG. 8, can be inclined at an angle to the direction of the wind, so that despite the deflection of the concentrated air draft S as effected by the cross wind W, an essentially vertically and upwardly directed shielding of the warm exhaust air of the heat exchange elements E is effected, and a recirculation of the warm exhaust air is prevented, even at these unfavorable wind conditions.

The present invention is, of course, in no way restricted to the specific disclosure of the specification and drawings, but also encompasses any modifications within the scope of the appended claims.

What I claim is:

1. In a forced-air cooled condenser system having a plurality of heat exchange elements including middle heat exchange elements therewith to which cooling air is fed via fans; the heat exchange elements all of which are disposed directly by a turbine housing, and are disposed parallel to one another;

the improvement therewith comprising: a condenser system having an edge which extends parallel to said turbine housing, and two edges which extend at right angles to said turbine housing, and means to provide a concentrated air draft having a velocity flow in the form of a sort of aerodynamic wall being blown out along at least that edge of said condenser system which extends parallel to said turbine housing; the velocity of flow of said air draft being greater than the exit velocity of said cooling air from those middle heat exchange elements which are disposed between said last-mentioned edge and said turbine housing.

2. A condenser system according to claim 1, which includes at least one of stronger fans and additional fans in those heat exchange elements disposed in an edge of said condenser system to effect said blowing out of said concentrated air draft.

3. A condenser system according to claim 1, in which those heat exchange elements disposed in an edge of said condenser system are provided on their upper side with induced-draft type fans for producing said concentrated air draft; and in which said heat exchange elements in the middle of said condenser system are provided on their bottom side with forced-draft type fans.

4. A condenser system according to claim 1, which includes means for producing additional air which in turn produces said concentrated air draft.

5. A condenser system according to claim 4, in which said means comprises blowers provided in an edge of said condenser system.

6. A condenser system according to claim 4, which includes separate air conduits along an edge of said condenser system for guiding said additional air.

7. A condenser system according to claim 4, which includes nozzles through which said concentrated air draft exits, said nozzles serving to concentrate and accelerate the exhaust of said means for producing additional air.

8. A condenser system according to claim 1, which includes nozzles through which said concentrated air draft exits, said nozzles serving to concentrate and accelerate the exhaust of said fans.

9. A condenser system according to claim 8, in which said nozzle is, at least in part, a slotted nozzle which extends at least partially over the length of an edge of said condenser system.

10. A condenser system according to claim 8, in which the exit direction of air from said nozzles is essentially vertical.

11. A condenser system according to claim 8, in which the exit direction of air from said nozzles is inclined at an angle opposed to a main wind direction.

* * * * *